US007950537B1

(12) United States Patent
Goodman et al.

(10) Patent No.: US 7,950,537 B1
(45) Date of Patent: May 31, 2011

(54) VENTILATED SHELF DIVIDER

(75) Inventors: Sheldon H. Goodman, Solon, OH (US); Omer I. Sazir, Cleveland, OH (US)

(73) Assignee: Spectrum Diversified Designs, Inc., Streetsboro, OH (US)

( * ) Notice: Subject to any disclaimer, the term of this patent is extended or adjusted under 35 U.S.C. 154(b) by 650 days.

(21) Appl. No.: 12/017,182

(22) Filed: Jan. 21, 2008

(51) Int. Cl.
*A47F 5/00* (2006.01)

(52) U.S. Cl. ..... 211/184

(58) Field of Classification Search ..... 211/184, 211/43, 44, 181.1; 108/60, 61; 206/561, 206/564

See application file for complete search history.

(56) References Cited

U.S. PATENT DOCUMENTS 1,881,614 A * 10/1932 Irving ..... 211/11
2,933,195 A * 4/1960 Radek ..... 211/153
3,739,918 A * 6/1973 Kreitzburg ..... 211/44
3,800,958 A * 4/1974 Dorn ..... 211/43
4,023,682 A * 5/1977 Niece ..... 211/184
4,341,314 A 7/1982 Feuerstein
5,269,447 A * 12/1993 Gower et al. ..... 224/542
5,411,146 A * 5/1995 Jarecki et al. ..... 211/59.2
5,437,380 A 8/1995 Peay et al.
6,116,436 A * 9/2000 Ferrucci et al. ..... 211/187
6,460,710 B1 * 10/2002 Dardashti ..... 211/184
6,619,489 B2 * 9/2003 Kessel et al. ..... 211/181.1
2009/0145869 A1 * 6/2009 Battaglia ..... 211/153

* cited by examiner

*Primary Examiner* — Sarah Purol
(74) *Attorney, Agent, or Firm* — Pearne & Gordon LLP

(57) ABSTRACT

A ventilated shelf divider comprises a downwardly opening frame assembly including laterally diverging wire walls that are releasably mountable to laterally spaced shelf wires. Each of the wire walls includes a plurality of spaced legs that extending to couplers for gripping the shelf wires. The legs may be manually moved towards one another and positioned between the shelf wires, and, upon release, the legs bias the couplers into gripping engagement with the shelf wires.

20 Claims, 3 Drawing Sheets

VENTILATED SHELF DIVIDER

BACKGROUND OF THE INVENTION AND RELATED ART

The present invention relates to shelving and, more particularly, to releasable dividers for use in connection with ventilated shelving having spaced shelf wires. Such shelving is often found in home applications for use in pantry and closet storage.

It is also known to provide self-standing storage racks with shelves formed by spaced shelf wires as shown in U.S. Pat. No. 6,460,710. For purposes of holding stored items in an upright position, this patent discloses the use of a divider assembly mountable to the shelf wires. The divider assembly includes a bent wire arranged to resiliently bias coupler ends thereof into engagement with a shelf wire.

U.S. Pat. No. 5,437,380 shows the use of metal clips attached to a divider to releasably secure the divider to a wire deck. The metal clips include spaced hooks for engaging a deck wire and a clearance slot for passage of the crossing deck wire.

A wire retaining device for articles carried on a wire refrigerator shelf is shown in U.S. Pat. No. 4,023,682. The retainer comprises a downwardly opening spring wire having U-shaped clips formed in the terminal ends of the legs.

A stop device for use in connection with a wire refrigerator shelf is shown in U.S. Pat. No. 4,341,314. The stop device comprises a solid member of sufficient height to provide the stop function. Opposed recesses are formed in the lower portion of the stop device for engagement with adjacent shelf wires.

U.S. Pat. No. 5,411,146 discloses a shelving display system including an A-shaped support member having solid legs that terminate in inwardly opening hooks for engaging cross wires. The hooks are pressed into engagement with the cross wires by a threaded adjustment bolt extending between the legs and a wing nut.

SUMMARY OF THE INVENTION

A shelf divider having an open wire frame assembly or construction is provided. The divider includes downwardly diverging wire walls formed by the legs of the divider. The wire walls including the legs are resiliently compressed toward one another and positioned between shelf wires. Upon release, the wire walls and legs resiliently bias the divider into engagement with the shelf wires.

The divider assembly has an A frame type configuration and includes a central top element having a longitudinal axis extending parallel with the shelf wires. The wire walls containing the legs depend downwardly on each side of the central top element at an obtuse angle as measured from the horizontal. The legs are fixed to the central top element and the obtuse angle is sized to resiliently resist closing movement of the legs together and contact of the diverging walls.

Each of the wire walls contains a plurality of legs that terminate with a like number of couplers for engagement with the shelf wires. In this manner, the divider provides multiple mounting points to the shelf wires at laterally spaced locations and increased mounted stability with horizontal stabilization.

In a preferred arrangement, legs are provided in laterally spaced pairs formed of a continuous leg wire extending over and connected to the central top element. More particularly, a portion of the leg wire on opposite sides of the central top element is contained in each wire wall.

Each wire wall also contains a lower wall element extending generally parallel to the central top element. The lower wall element connects the remote or distal ends of the legs of the wire wall together adjacent the couplers.

BRIEF DESCRIPTION OF DRAWINGS

FIG. 5 is an elevational end view similar to

FIG. 4 showing the divider after release with the wire walls biasing the couplers into engagement with the shelf wires;

FIG. 6 is a perspective view is similar to

FIG. 1 showing the divider in an alternative mounting position adjacent the rear portion of the shelf.

DETAILED DESCRIPTION OF THE DRAWINGS

Figure 1:
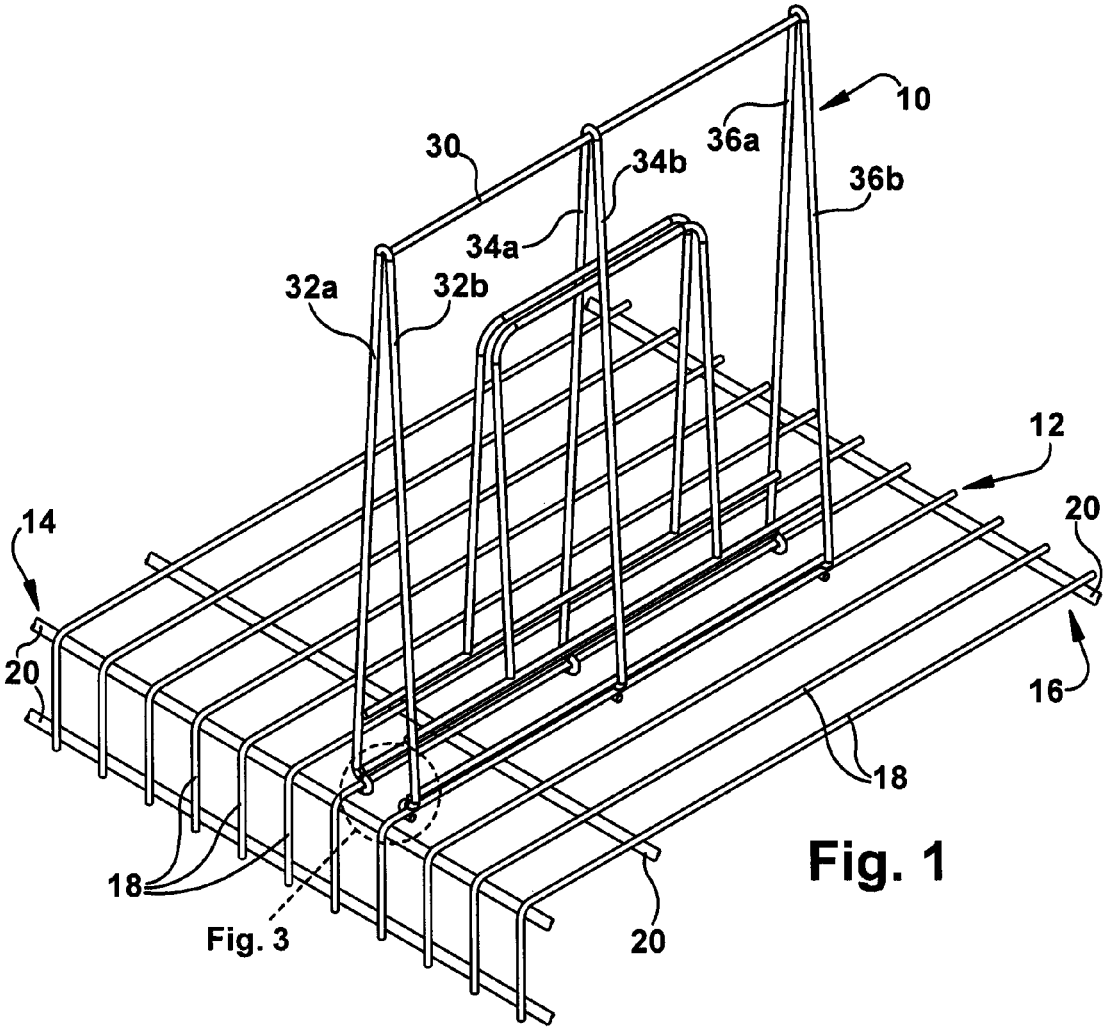
FIG. 1 is a fragmentary perspective view showing the divider in accordance with the invention mounted to ventilated shelf.

Referring to FIG. 1, a shelf divider 10 is shown mounted to a ventilated shelf 12. For purposes of orientation, the shelf front portion 14 is shown closest to the viewer and the shelf back portion 16 is shown remote of the viewer.

The shelf includes a plurality of longitudinal shelf wires 18, which cooperate to form the shelf support surface. For purposes of reinforcement and shelf rigidity, the shelf 12 also includes a plurality of heavier gauge, laterally extending wires 20. More particularly, two laterally extending wires 20 are disposed in a plane at the front extremity of the shelf, a third laterally extending wire 20 is located adjacent to the shelf front portion 14 and a fourth laterally extending wire 20 is provided along the shelf back portion 16. The wires 18 and 20 are welded together at crossover locations.

Figure 2:
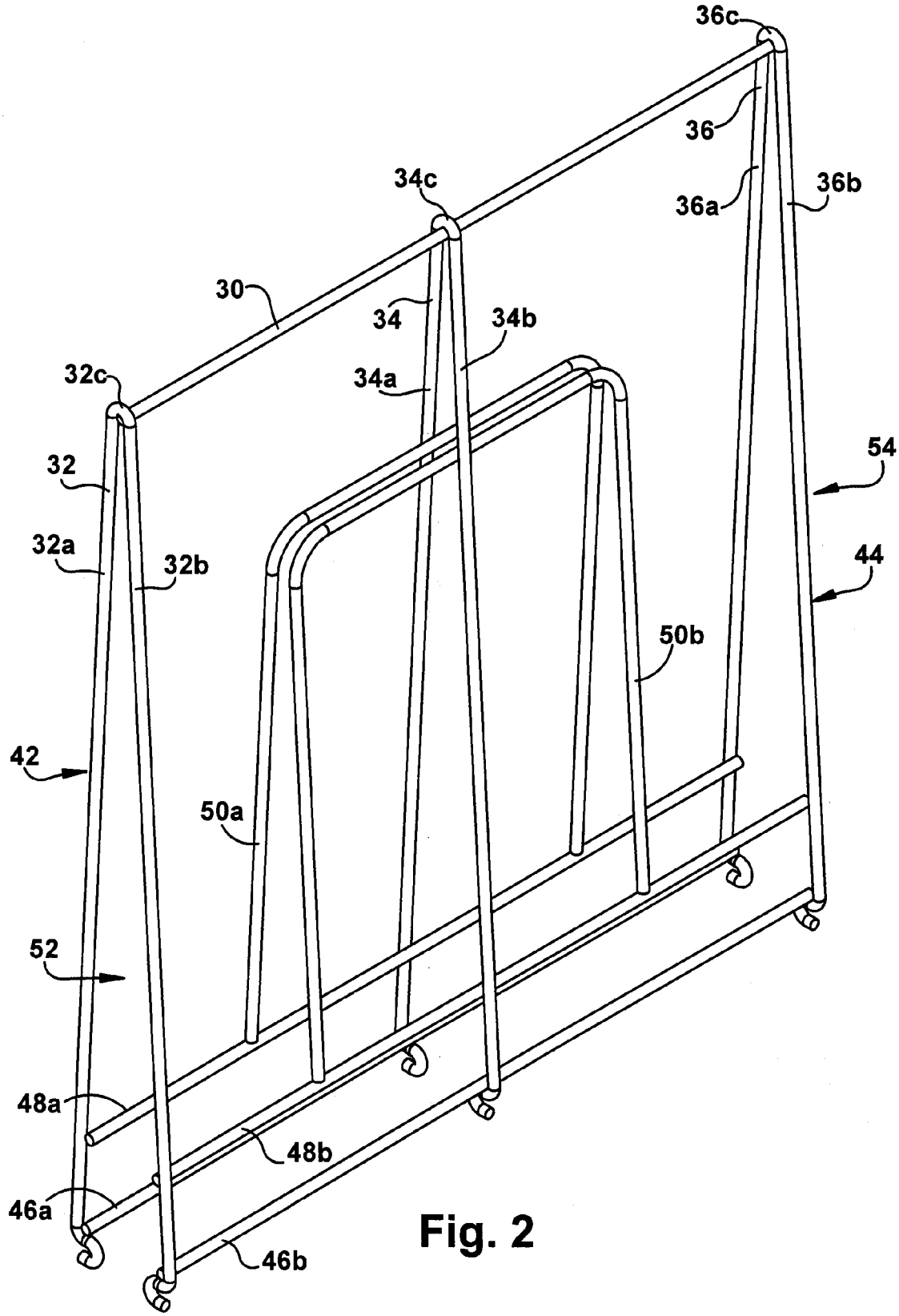
FIG. 2 is a perspective view on an enlarged scale of the divider shown in FIG. 1.

Referring to FIGS. 1 and 2, the shelf divider 10 includes a central top element or wire 30 extending in a longitudinal direction or from front to back portions of the shelf. Leg wires 32, 34 and 36 are supported by the wire 30 and each of the leg wires provides a pair of laterally spaced legs 32*a*, 32*b*, 34*a*, 34*b* and 36*a*, 36*b*. The leg wires 32, 34 and 36 are affixed to the wire 30 as by welding. To that end, each of the wires 32, 34 and 36 includes a small arcuate portion 32*c*, 34*c* and 36*c* extending over and welded to the wire 30.

The legs 32*a*, 34*a* and 36*a* extend at an obtuse angle from the wire 30 and cooperate to form a diverging wire wall 42 on one side of the wire 30. In a similar manner, the legs 32*b*, 34*b* and 36*b* extend from the opposite side of the wire 30 at a similar obtuse angle and cooperate to form a diverging wire wall 44. The obtuse angle should be greater than about 140°, preferably greater than about 150°, and more preferably greater than about 160°.

The distal ends of the legs are connected to a lower wall element 46*a* in the wire wall 42 and to a lower wall element 46*b* in the wire wall 44. Further reinforcement is provided adjacent to the lower extremities of the walls by lower wall elements 48*a* and 48*b*. Each of these elements is secured together at crossover points by welding.

Each of the wire walls 42 and 44 is further reinforced by U-shaped reinforcing wires 50*a* and 50*b*. Each of the U-shaped reinforcing wires 50*a* and 50*b* is secured to the divider 10 by three separate welds. For example, the U-shaped reinforcing wire 50*a* has each end thereof welded to the lower wall element 48*a* and the mid-point of the U-shaped reinforcing wire 50*a* is welded to the leg 34*a* at the crossover location. The reinforcing wires 50*a* and 50*b* may be provided with other geometric shapes or an aesthetic design shape.

In the foregoing manner, each of the wire walls 42 and 44 is provided with an open framework of substantial rigidity. For example, the wire wall 42 includes at its periphery, the wire 30, legs 32*a* and 36*a* and lower wall element 46*a*. In addition, interior reinforcement is provided by the leg 34*a*, the lower wall element 48*a* and the U-shaped reinforcing wire 50*a*.

The divider 10 has an open front longitudinal end 52 provided by the leg wire 32 and an open back longitudinal end 54 provided by the leg wire 36. This open end construction in combination with the rigidity of the wire walls 42 and 44 facilitate the installation, adjustment and disengagement of the divider from the shelf 12 as described more fully below.

Figure 3:
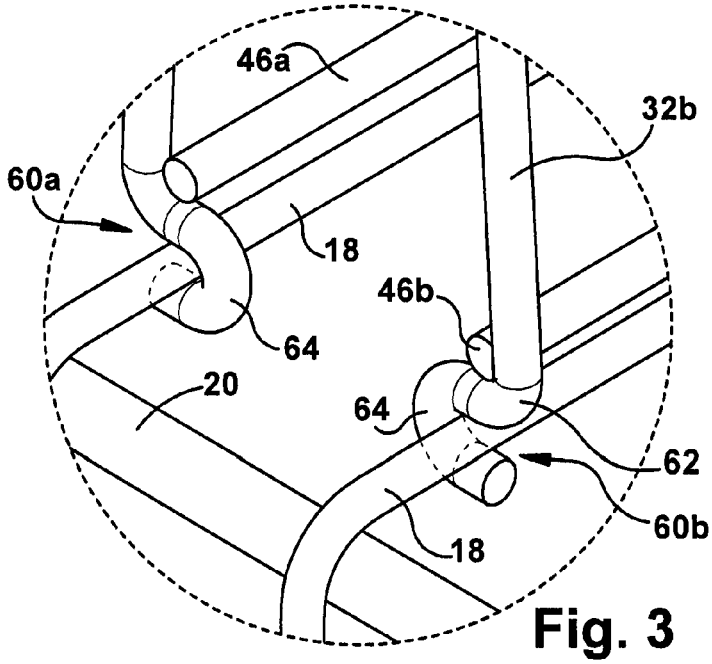
FIG. 3 is a fragmentary perspective view on an enlarged scale taken along the line 3 in FIG. 1.

As best shown in FIG. 3, a coupler 60*b* is integrally formed in the end of the leg 32*b*. More particularly, a reverse bend 62 formed in the leg 32*b* cups the lower wall element 46*b* to provide increased stability at the coupler 60*b*. The leg 32*b* further extends from the bend 62 to form a laterally open C-shape hook 64. The C-shape hook 64 is sized to receive the shelf wire 18.

Similar couplers 60*b* are integrally formed in the ends of each of the legs 34*b* and 36*b*. Couplers 60*a* formed in the ends of the legs 32*a*, 34*a* and 36*a* are mirror images of the coupler 60*b*.

Figure 4:
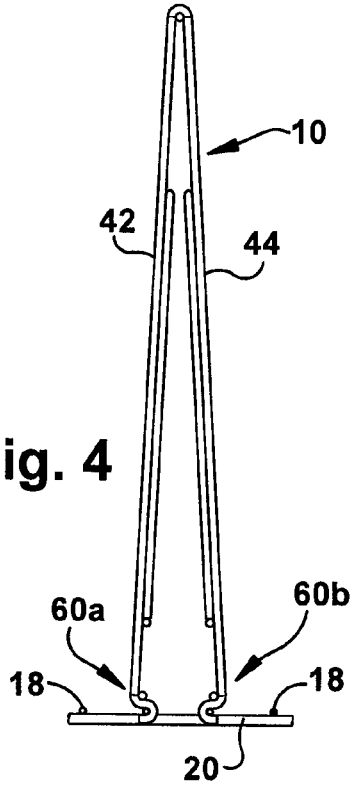
FIG. 4 is an elevational end view showing the divider with the wire walls squeezed together for installation of the divider between the spaced shelf wires.
Figure 5:
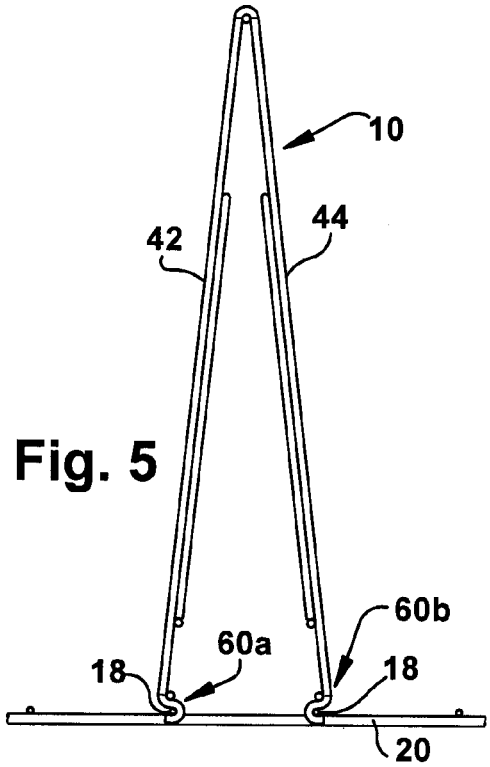

The open longitudinal ends 52 and 54, in combination with the rigid construction of the wire walls 42 and 44, enable the divider to be easily manipulated by hand during installation, position adjustment or removal. More particularly, laterally opposed legs and/or portions of the U-shaped elements 50*a* and 50*b* may be gripped with one hand and squeezed so as to disengage all of the couplers 60*a* and 60*b* from the shelf wires 18 as shown in FIG. 4. The rigidity of the wire walls 42 and 44 is sufficient to enable local compression or squeezing together of some of the wire wall elements to cause disengagement of all of the couplers. Upon release, the wire walls 42 and 44 return to their normal condition and bias the couplers 60*a* and 60*b* into engagement with the shelf wires 18.

As shown in the drawings, divider 10 is bilaterally symmetrical about a vertical plane passing through the longitudinal axis of the wire 30. Accordingly, the divider may be manufactured in a planar or "unfolded" condition (not shown). For example, the leg wires 32, 34 and 36 may be positioned at the desired spacing and secured together by weldments at the cross over locations with lower wall elements 46*a*, 46*b*. The ends of the leg wires may then be formed to provide couplers 60*a* and 60*b*. The lower wall elements 48*a* and 48*b* may then be welded to the leg wires 32, 34 and 36. Further, the U-shaped reinforcing wires 50*a* and 50*b* may be welded to the partially formed divider at their associated wire crossover locations. The planar assembly may then be folded along the axis of the wire 30 to dispose the legs and the wire walls in the selected obtuse angle.

Figure 6:
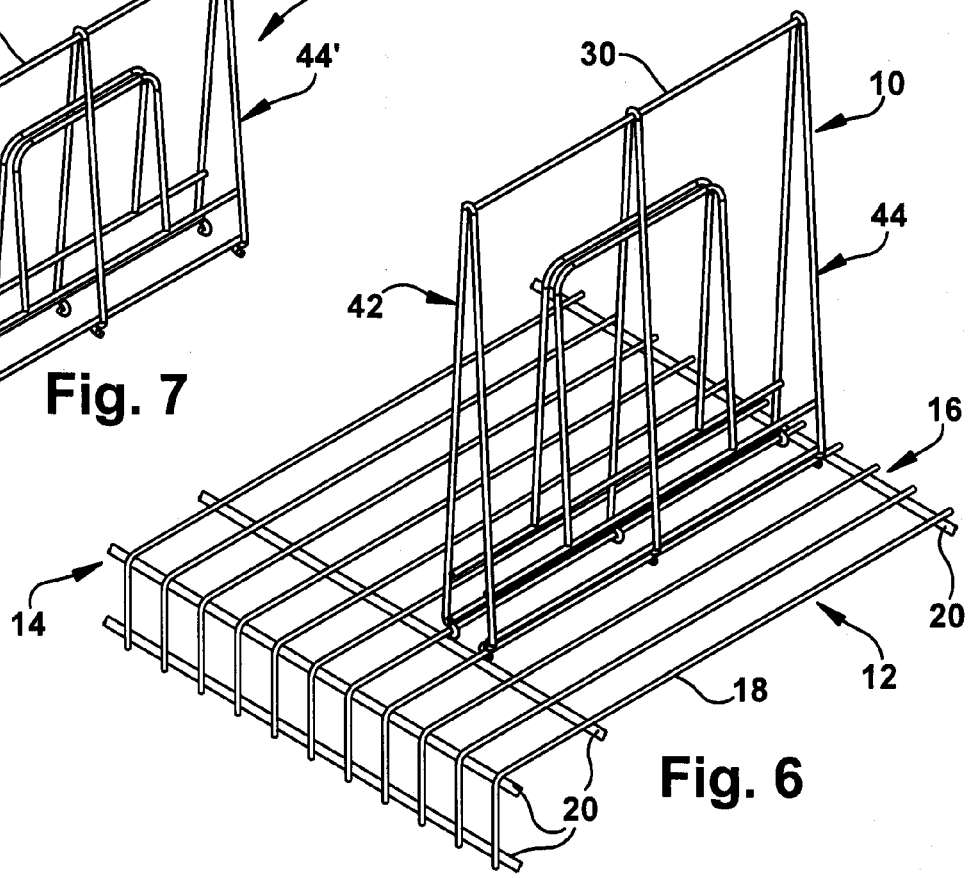

The divider 10 has an overall longitudinal length of about 9.125" inches and a height of about 8.125" as measured in a vertical plane passing through the wire 30. This enables it use with most closet type shelving having longitudinal length or depth of about 12". Moreover, the divider may be positioned closer to the front portion 14 of the shelf 12 as shown in FIG. 1 or closer to the back portion 16 as shown in FIG. 6. Of course, the divider 10 may also be positioned at intermediate locations between the front and back of the wire shelf as desired.

In a normal or non-compressed condition, the divider 10 has a lateral width between the openings of the C-shape hooks 64 greater that than the lateral spacing between the shelf wires 18. This lateral width enables the resilient mounting between the shelf wires.

The lateral normal width of the divider 10 is more than about one inch. For example, a 1.25" lateral width has been found to provide sufficiently resilient gripping by the couplers for mounting between shelf wires positioned on 1" centers as used in many residential closet shelves. On the other hand, the couplers may be compressed together to allow engagement and mounting to shelf wires positioned on 0.5" centers as used in many residential pantry shelves.

The divider 10 may be provided with a normal or non-compressed lateral width between the openings of the C-shape hooks 64 in the range of from about ⅜" inch to about 1.25" depending upon the shelf wire spacing. It should be appreciated that a divider having a relatively larger lateral spacing may be mounted to non-adjacent shelf wires so as to skip one or more intermediate shelf wires.

It has also been found that the wire walls 42 and 44 of the divider 10 may be readjusted from time-to-time to increase the lateral width or spacing between the openings of the C-shape hooks 64. This readjustment renews and increases the resilient gripping of the shelf wires 18.

Figure 7:
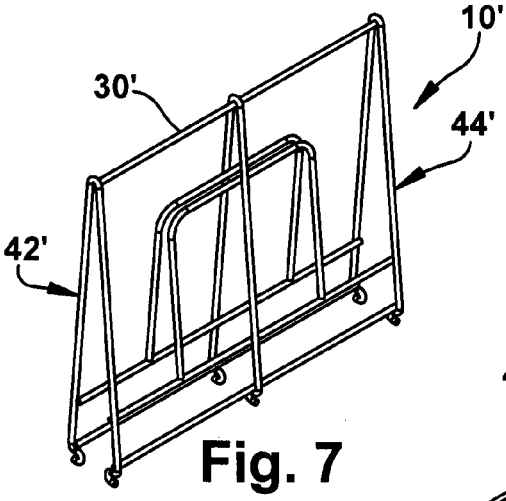
FIG. 7 is a fragmentary perspective view similar to FIG. 1 showing a second embodiment of the divider in accordance with the invention.

Referring to FIG. 7, a shelf divider 10' in accordance with a second embodiment of the invention is shown. The shelf divider 10' has a construction similar to that of the divider 10 and corresponding elements are identified by like reference numerals with the addition of a prime designation.

The shelf divider 10' has a height of increased dimension and a more rectangular shape as compared with the divider 10. The divider 10' has height of 12.125" as measured in a vertical plane passing through the wire 30' and a longitudinal length of 10.625". Of course, the height and longitudinal length may be selected for particular shelf applications. For example, the divider 10' may have a height in the range of from about 10" to about 13". The wire walls 42' and 44' would have correspondingly increased dimensions. Similarly, the longitudinal length of the divider 10' may be 10" or greater in accordance with the shelf depth.

The dividers 10 and 10' are formed of round steel wire of the type typically used in wire formed products for residential applications. Thus, the wire has a diameter of 0.14" or 3.5 mm.

As illustrated, the dividers 10 and 10' may be finished by powder coating or plating to match residential shelf finishes. In either case, the finishes are not marred by the manufacturing process.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A ventilated shelf divider releasably mountable to laterally spaced shelf wires that form a generally horizontal shelf, said shelf divider comprising a downwardly opening frame assembly including a central top element having a longitudinal axis extending parallel with said shelf wires and laterally diverging wire walls extending from said top element to a frame assembly bottom, each of said wire walls including three pairs of spaced legs fixed to said top element and extending to said frame assembly bottom, a lower wall element in each wire wall extending generally parallel to said central top element and connecting said legs together in the wire wall remote of said central top element, and a reinforcing member extending between spaced locations on said lower wall element and an upper location on one of said three pairs of legs, each of said legs providing couplers for gripping said shelf wires adjacent said frame assembly bottom, said legs being manually movable towards one another for positioning said couplers between shelf wires, so that upon release, said legs bias said couplers into gripping engagement with said shelf wires.

2. The divider of claim 1, wherein each of said wire walls depends downwardly at an obtuse angle as measured from the horizontal on each side of said central top element, each of said legs being fixed to said central top element to resiliently resist closing movement of the legs together and contact of the diverging walls.

3. The divider of claim 2, wherein each of said legs comprise continuous leg wires fixed to said central top element so that portions of each of said leg wires on opposite sides of said central top element form said pairs of said legs, one of said legs of each pair of said legs extending in an associated one of said diverging wire walls.

4. The divider of claim 3, wherein each of said continuous leg wires is contained in a leg plane that is substantially perpendicular to a plane passing through said longitudinal axis of said central top element.

5. The divider of claim 4, wherein each of said diverging wire walls is contained in a wall plane, and said wall planes intersect adjacent said central top element.

6. The divider of claim 1, wherein each of said wire walls includes a second lower wall element extending generally parallel to said central top element and connecting said legs together remote of said central top element, said second lower wall element being located between said first mentioned lower wall element and said couplers, said first and second lower wall elements being positioned in each of said diverging wire walls closer to each other than to said central top element.

7. The divider of claim 1, wherein said lower wall element in each wire wall connects said legs together such that one pair of legs may be manually squeezed together by hand to release all of said couplers provided by said three pairs of legs from engagement with said shelf wires.

8. The divider of claim 7, wherein said coupler includes a C-shape hook that opens laterally outwardly to frictionally engage an adjacent shelf wire.

9. The divider of claim 8, wherein said leg includes a reverse bend at its distal end that forms said C-shape hook.

10. The divider of claim 1, wherein said horizontal shelf has a front and a back, said divider has a first open end to be releasably mounted to said shelf wires by said couplers adjacent the front of said shelf and a second open end to be releasably mounted to said shelf wires by said couplers adjacent the back of said shelf.

11. The divider of claim 10, wherein said three pairs of spaced legs include a first pair of said legs forming said first open end, a second pair of said legs forming said second open end, and a third pair of said legs located intermediate said first and second pairs of legs.

12. The divider of claim 11, wherein each of said pairs of legs is formed by a continuous leg wire having a central arc portion that is connected to said top central element and movement of said wire walls toward and away from each other is resisted by said legs.

13. The divider of claim 12, wherein said wire walls may be closed to a spacing for mounting to shelf wires having a center-to-center spacing of about ½" or opened to a spacing for mounting to shelf wires having a center-to-center spacing of about 1".

14. The divider of claim 1, wherein said reinforcing member comprises a U-shape wire having reinforcing legs connected by a central bight, said reinforcing legs being fixed to said lower wall element and extending to said central bight, said central bight being fixed to an upper location on one of said three pairs of legs.

15. The divider of claim 1, including a second reinforcing member, one of said reinforcing members being mounted in each of said wire walls.

16. The divider of claim 1, wherein said divider is bilaterally symmetrical about a vertical plane passing through said central top element.

17. A ventilated shelf divider releasably mountable to laterally spaced shelf wires that form a generally horizontal shelf, said shelf divider comprising a downwardly opening frame assembly including a central top element from which laterally diverging wire walls extend to lower wall elements that cooperate to form a frame assembly bottom, each of said wire walls including a plurality of continuous leg wires fixed to said central top element so that portions of each of said leg wires on opposite sides of said central top element form pairs of legs, one of said legs of each pair of said legs extending to one of said lower wall elements in an associated one of said diverging wire walls, a reinforcing member extending between spaced locations on said lower wall element and an upper location on one of said pairs of legs in each of said diverging walls, said legs terminating at couplers for gripping said shelf wires, and said legs being manually movable towards one another for positioning between shelf wires, so that upon release, said legs bias said couplers into gripping engagement with said shelf wires.

18. The divider of claim 17, wherein said reinforcing members comprise U-shape wires having reinforcing legs connected by a central bight, said reinforcing legs being fixed to said lower wall element at spaced locations and extending to said central bight, said central bight being fixed to an upper location on one of said pairs of legs.

19. The divider of claim 18, wherein said horizontal shelf has a front and a back, said divider has a first open end to be releasably mounted to said shelf wires by said couplers adjacent the front of said shelf and a second open end to be releasably mounted to said shelf wires by said couplers adjacent the back of said shelf, and said divider includes a first pair of said legs forming said first open end, a second pair of said legs forming said second open end, and a third pair of said legs located intermediate said first and second pairs of legs.

20. The divider of claim 18, wherein each of said lower wall elements is spaced from said couplers and frame assembly bottom.

* * * * *